United States Patent [19]

Fiorentino

[11] 3,946,768

[45] Mar. 30, 1976

[54] WIRE HARNESS BOARD

[75] Inventor: Arthur A. Fiorentino, Piscataway, N.J.

[73] Assignee: Thomas & Betts Corporation, Elizabeth, N.J.

[22] Filed: July 25, 1972

[21] Appl. No.: 275,073

[52] U.S. Cl. ..... 140/92.1; 29/203 B

[51] Int. Cl.[2] ..... B21F 3/00

[58] Field of Search ..... 29/203 B, 203 J, 203 MW, 29/593, 628; 339/96; 324/51; 140/92.1

[56] References Cited

UNITED STATES PATENTS

| | | | |
|---|---|---|---|
| 3,633,096 | 1/1972 | Bollman | 324/51 |
| 3,653,411 | 4/1972 | Mosher et al. | 29/203 MW |
| 3,668,762 | 6/1972 | Clark | 29/203 B |
| 3,681,835 | 8/1972 | Evans et al. | 29/203 MW |

*Primary Examiner*—C. W. Lanham
*Assistant Examiner*—D. M. Gurley
*Attorney, Agent, or Firm*—David Teschner; Jesse Woldman

[57] ABSTRACT

A wire harness board comprises a foamed plastic panel, a first layer of wire mesh secured to one surface of the panel, a second layer of wire mesh secured in parallel relationship to the opposite surface of the panel, and a border that snugly fits over the parallel surfaces of the foamed panel with the wire mesh joined thereto. A unique method of forming such wire harness board, including the application of heat and pressure for a predetermined interval of time, is also disclosed.

3 Claims, 6 Drawing Figures

WIRE HARNESS BOARD

CROSS-REFERENCE TO RELATED APPLICATION

A fuller appreciation of the instant invention may be obtained by reference to pending U.S. Pat. application Ser. No. 193,082, filed Oct. 27, 1971, now U.S. Pat. No. 3,752,198 in the name of Arthur A. Fiorentino and Alan C. McCree. Such application, which relates to the so-called modularity concept which enables a single sized, or universal, harness board to be built-up to any desired harness board size, has been assigned to the assignee of the instant application.

FIELD OF THE INVENTION

The instant invention relates to wire harness boards for facilitating the tying together of wires forming a harness and methods of forming such boards.

DESCRIPTION OF PRIOR ART

Wire harness devices, also known as boards or jig-boards, that have been fabricated from several layers of wood or metal are well known; a representative device is disclosed in U.S. Pat. No. 3,346,020 issued to George H. Geisinger and has gained broad commercial acceptance. Such device employs a first or fixed upper board and a second or movable lower board disposed in parallel relationship; means are provided for moving the boards relative to one another. A sheet or stencil is secured to the work surface of the fixed board indicating the desired outline of the wire harness and the necessary pin locations. The pins are then driven through the fixed board at the necessary locations and into the lower board. Subsequently, the user routes or positions the bundle of wires between the pins. Upon completion of the routing operation, the boards are moved apart so that the pins are lowered to a level that does not interfere with the application of bundling straps, termination springs, etc., to the wire bundle. Lastly, the completed harness is removed from the wire harness device and the device may be reused for forming another wire harness in accordance with the sheet or stencil applied to the upper surface of the first board.

Whereas the above described wire harness devices function satisfactorily, several deficiencies have been encountered. For example, the process of removing the elongated pins from the boards is time-consuming and expensive; thus, the boards and pins are frequently discarded after but a single usage and several boards have to be maintained on hand at all times. Furthermore, the mechanisms necessary to move the boards relative to one another introduces an undesirable factor into the cost of forming the wire harnesses. Additionally, manual tools are required for driving the pins through the boards, and/or for removing same.

Alternative wire harness devices have been sought which would alleviate the deficiencies while maintaining the successful functional characteristics of the multilayered harness devices. To illustrate, U.S. Pat. No. 3,633,096 issued to Clifford J. Bollman discloses a wire harness board including first and second metallic screens positioned in spaced parallel relationship on the top and bottom surfaces of a penetrable core. The core may be formed in two equal halves from honeycombed paper, cork, foam rubber, or particulate matter, and a third metallic screen is inserted between the two halves to impart structural rigidity. The openings in each of the three metallic screens are oriented randomly relative to the openings in the adjacent screen, so as to provide increased frictional contact with the elongated pins inserted therethrough. The screens and the core halves are secured together by fasteners which are passed through the several layers of the wire harness board.

While the harness board disclosed by Bollman may well solve some of the deficiencies encountered with known multilayered harness boards, other problems remain unresolved. To illustrate, since a plurality of components are utilized for each board, problems may be encountered in aligning the components so that the pins can be easily inserted therethrough and yet be maintained in the desired position by frictional forces. Furthermore, the vertically oriented fasteners that retain the components in the desired relationship exert a constant pull or tensioning force of the screens which tends to shorten the useful life of the board.

SUMMARY OF THE INVENTION

Thus, with the shortcomings of known wire harness devices clearly in mind, the instant invention contemplates a harness board utilizing a panel of foamed plastic bounded on its top and bottom surfaces by parallel layers of wire mesh. The foamed plastic panel has "self-healing" properties which enable the pins to be inserted into the board repeatedly during the course of fabricating several different harnesses. The mesh layers, which are embedded into the plastic panel without resorting to fasteners, increase the useful life of the board by effortlessly guiding the pins therethrough.

The invention further contemplates an efficient method of fabricating such board which bonds the wire mesh layers to the foam panel by the application of heat and pressure. The wire mesh layers and the foam panel are then slipped, as a unit, into a C-shaped border element and are retained therein by a suitable adhesive.

Additional desirable objectives realized by the instant wire harness board, and the method of fabricating same, will become readily apparent from the ensuing specification when construed in harmony with the accompanying drawings.

DESCRIPTION OF THE PREFERRED EMBODIMENT

Figure 1:
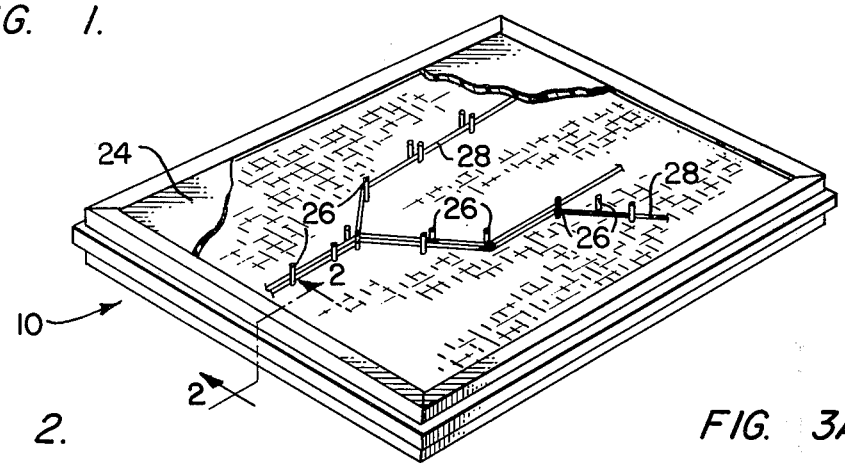
FIG. 1 is a perspective view of a harness board constructed in accordance with the principles of the instant invention.
Figure 2:
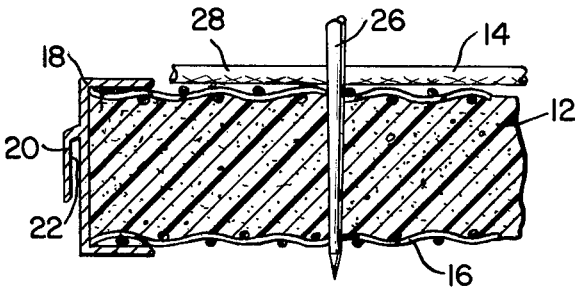
FIG. 2 is a vertical cross-sectional view through a section of the harness board, such view being taken along line 2—2 in FIG. 1 and in the direction indicated.

Referring now in greater detail to the drawings, FIGS. 1 and 2 show a harness board constructed in accordance with the principles of the instant invention, such board being indicated generally by reference numeral 10. Board 10 includes a panel 12 of a resilient material, such as a foamed polyethylene plastic, a first layer 14 of wire mesh joined thereto, a second layer 16 of wire mesh joined thereto and an inwardly opening, C-shaped border 18 that fits over the top and bottom surfaces of the foamed panel. Border 18, which consists of a plurality of segments secured together in edge-to-edge contact, extends around the perimeter of the rectangular board 10 and is secured thereto by a suitable adhesive. An arm 20 extends downwardly from border 18 and a slot 22 is defined between the arm and the border.

A harness layout sheet or stencil 24, fragmentarily shown in the lower left hand corner of the board, is positioned atop board 10 so that the outline of the desired harness configuration may be readily observed. Elongated pins 26 are inserted through at least the first layer 14 of wire mesh and panel 12, and, in some instances, through the second layer 16 of wire mesh, in accordance with the pin locations indicated on the layout sheet or stencil 24. Pins 26 physically define the boundaries of the desired harness form, and then wires 28 are threaded between the pins. Subsequently, the wire harness is completed by securing wires together into a bundle by passing bundling straps axially thereabout (not shown) and by securing the ends of the wires to appropriate termination devices (not shown).

Figure 3A:
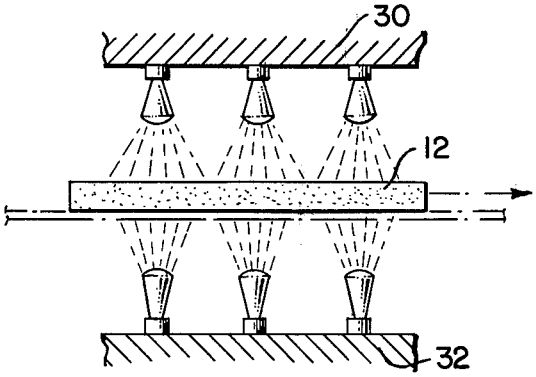
FIGS. 3A–3D depict successive steps in the unique process of fabricating the harness board.

FIGS. 3A–3D depict sequentially steps in the unique method of fabricating board 10. A panel 12 of foamed plastic is cut to size and is then passed between upper and lower banks of heating lamps 30 and 32, respectively, so that the exposed upper and lower faces of the panel become tacky and pliable, as shown in FIG. 3A. The lamps heat the surfaces of panel 12 to at least 325° F; although temperatures greater than 325° F are permissible, temperatures in excess of 400° F will cause the foam panel to shrink away from the mesh layer.

Figure 3B:
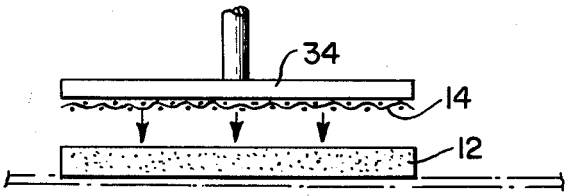

After the heating operation, panel 12 is advanced into operative relationship to press 34, as shown in FIG. 3B. Layer 14 of wire mesh is inserted into the press, and then the press moves downwardly and securely embeds the mesh in the foam panel. Press 34 must exert a load at least one pound of pressure per square inch in order to permanently embed the mesh, and the mesh must be embedded to a depth of at least one-half of its overall thickness for optimum results. Excessive pressure, however, will cause a permanent reduction of the overall thickness of the assembled board.

Figure 3C:
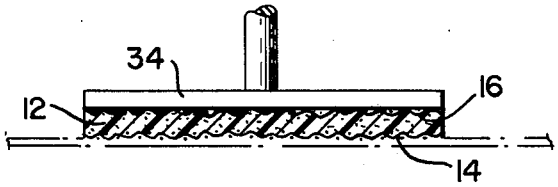

After layer 14 is firmly embedded in panel 12, the panel is inverted and the second layer 16 of wire mesh is embedded into the exposed surface of panel 12, as indicated in FIG. 3C. Here again, a minimum load of at least one pound of pressure per square inch is required for successful bonding; similarly, the mesh must be embedded to a depth of at least one-half of its overall thickness.

Figure 3D:
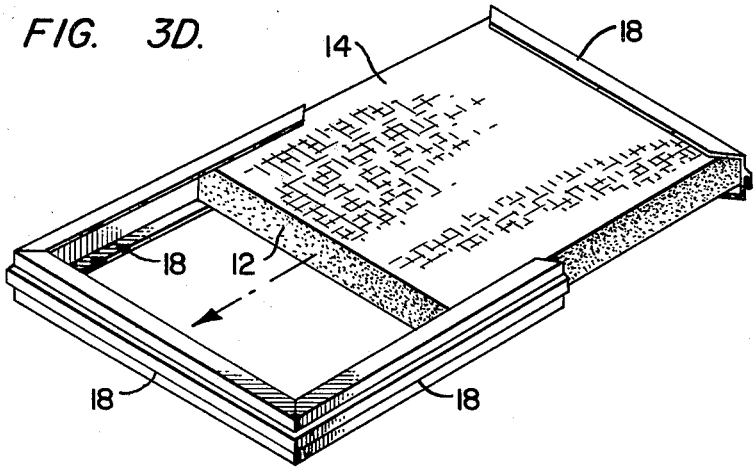

One of the C-shaped segments that make up the rectangular border 18 is then slipped over one end of panel 12 with the mesh layers 14, 16 firmly embedded therein. The remaining C-shaped segments are united into a horizontally extending U-shaped structure, as shown in FIG. 3D. Border 18 has adhesive placed on its inner surface so that it can be firmly secured to the mesh layers. Alternatively, if so desired, the adhesive may be added to the surface of layers 14, 16 and to the edge of foam panel 12. Lastly, the panel is inserted into the open end of the U-shaped structure and is adhesively secured thereto; the assembly is completed when the border sections are subsequently united by conventional techniques.

Although a preferred embodiment of the instant wire harness board, and a preferred method for fabricating same have been described above, it will be appreciated that numerous changes could be effectuated without departing from the thrust of this invention. For example, if desired, layers 14 and 16 of wire mesh need not be aligned and thus could be applied simultaneously to opposite faces of the central panel. The bonding time for each panel varies over a range of 1–5 minutes per panel, depending upon the temperature and pressure employed. Also, although the panel may satisfactorily utilize polyethylene foam, polystyrene, polyurethane, or other closed cell foams could also be used.

The closed cell structure of the foamed plastic panel inherently possesses a self-healing property that permits numerous and repeated insertions of various harnessing aids over the prolonged life span of the wire harness board. Moreover, since the layers of wire mesh are permanently embedded in the foam panel by a heat bond, without resorting to conventional fasteners passing therethrough for securement purposes, the wire mesh layers, which merely act as guides for the pins, are unstressed and not placed under constant tension. The absence of tension increases the useful life span of the wire board and thereby broadens its commercial appeal. The wire mesh layers need not be aligned with one another, but the openings in the mesh must be equal to, or slightly larger, than the diameter of the pins. In an exemplary embodiment, the pin diameter was 0.093 inches, while each opening in the wire mesh was 0.093 by 0.093 inches.

In light of the foregoing specification, it should be fully understood that many other modifications and embodiments can be devised by those skilled in the art to which this invention appertains that will fall within the spirit and scope of the principles of this invention.

I claim:

1. A wire harness board comprising:

a. a panel including a body with upper and lower parallel surfaces, b. said panel being formed of a resilient closedcell material, c. first and second layers of wire mesh secured to the upper and lower surfaces of said panel, d. an inwardly opening frame for receiving said panel and retaining same therewithin, e. a plurality of elongated pins detachably insertable through said panel and through selected openings in at least one of said layers of wire mesh, f. the openings in the wire mesh being slightly greater in size than the diameter of the pins inserted therethrough, the invention being characterized in that said wire mesh layers are permanently embedded within the body of said panel at the upper and lower surfaces thereof so that said pins are guided in a vertical direction through said panel.

2. A wire harness board as defined in claim 1 wherein the panel of resilient material consists of a foamed, cellular plastic that becomes tacky when exposed to temperatures ranging between 325°F. and 400°F.

3. A wire harness board as defined in claim 1 wherein the layers of wire mesh are embedded in the panel to a depth corresponding to one-half of the thickness of the mesh.

* * * * *